US008852751B2

(12) United States Patent
Smith et al.

(10) Patent No.: US 8,852,751 B2
(45) Date of Patent: Oct. 7, 2014

(54) WEAR RESISTANT DEVICE AND PROCESS THEREFOR

(75) Inventors: Blair A. Smith, South Windsor, CT (US); Aaron T. Nardi, East Granby, CT (US); Kevin M. Rankin, Windsor, CT (US); Patrick Louis Clavette, Simsbury, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 538 days.

(21) Appl. No.: 12/566,759

(22) Filed: Sep. 25, 2009

(65) Prior Publication Data

US 2011/0073217 A1 Mar. 31, 2011

(51) Int. Cl.
*C23C 30/00* (2006.01)

(52) U.S. Cl.
USPC ..... 428/545; 428/427; 428/432; 428/433; 148/279

(58) Field of Classification Search
USPC ..... 148/279; 428/545, 427, 432, 433
See application file for complete search history.

(56) References Cited

U.S. PATENT DOCUMENTS

| | | | | |
|---|---|---|---|---|
| 3,744,979 | A | 7/1973 | Kalish | |
| 3,811,961 | A | 5/1974 | Ellis | |
| 4,236,926 | A | 12/1980 | Lindholm | |
| 4,396,077 | A * | 8/1983 | Radtke | 175/428 |
| 4,402,764 | A | 9/1983 | Clark | |
| 5,072,771 | A * | 12/1991 | Prasad | 164/122.1 |
| RE33,896 | E | 4/1992 | Maghon et al. | |
| 5,306,120 | A | 4/1994 | Hammer et al. | |
| 5,601,933 | A | 2/1997 | Hajmrle et al. | |
| 5,881,972 | A | 3/1999 | Smith et al. | |
| 5,916,518 | A | 6/1999 | Chesnes | |
| 6,478,887 | B1 | 11/2002 | Sue et al. | |
| 6,635,362 | B2 | 10/2003 | Zheng | |
| 2005/0112399 | A1 * | 5/2005 | Gray et al. | 428/678 |
| 2005/0170201 | A1 | 8/2005 | Ware et al. | |
| 2006/0251910 | A1 | 11/2006 | Lancsek | |
| 2007/0172695 | A1 | 7/2007 | Nardi et al. | |
| 2009/0178736 | A1 | 7/2009 | Smith et al. | |

FOREIGN PATENT DOCUMENTS

| | | | | |
|---|---|---|---|---|
| EP | 0416947 | | 3/1991 | |
| EP | 1927670 | * | 6/2008 | C23C 4/06 |
| JP | 58117896 | | 7/1983 | |
| JP | 59-123793 | * | 7/1984 | C25D 15/02 |
| JP | 59123793 | | 7/1984 | |
| JP | 4088159 | | 3/1992 | |
| JP | 7145471 | | 6/1995 | |

OTHER PUBLICATIONS

EP Search Report for EP10251654.

* cited by examiner

*Primary Examiner* — Lois Zheng
(74) *Attorney, Agent, or Firm* — Carlson, Gaskey & Olds, P.C.

(57) ABSTRACT

A wear resistant device includes a substrate of a first metallic material and a wear resistant layer disposed on a substrate. The wear resistant layer includes a matrix of a second, different metallic material, particulates dispersed throughout the matrix, and a boron material dispersed within a portion of the matrix.

19 Claims, 1 Drawing Sheet

WEAR RESISTANT DEVICE AND PROCESS THEREFOR

BACKGROUND

This disclosure relates to materials and compositions for enhanced wear resistance.

Bore surfaces, shafts, and the like may include surfaces that are subject to wear conditions. Depending on the material, the surfaces may be directly hardened using a carburizing or nitriding process to improve wear resistance of such surfaces. In some cases, the surfaces may alternatively be plated with chromium to provide a greater degree of wear resistance.

More recently, there has been a desire to replace chromium. However, potential replacement materials have not been successful in providing the same degree of wear resistance as the chromium plating. Moreover, such materials do not exhibit a wide range of wear resistance with regard to different types of wear mechanisms, such as contact with hard particles, contact with mating components, and contact at elevated temperatures.

SUMMARY

An exemplary wear resistant device includes a substrate of a first metallic material and a wear resistant layer disposed on a substrate. The wear resistant layer includes a matrix of a second, different metallic material, particulates dispersed throughout the matrix, and a boron material distributed within a portion of the matrix.

In another aspect, the wear resistant device may be considered to be the wear resistant layer and may include a matrix of a metallic material, particulates dispersed throughout the matrix, and a boron material distributed within a portion of the matrix.

The exemplary wear resistant devices may be fabricated or processed by boronizing a wear resistant layer of a matrix of a metallic material and particulates dispersed throughout the matrix to provide a boron material distributed within a portion of a matrix.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
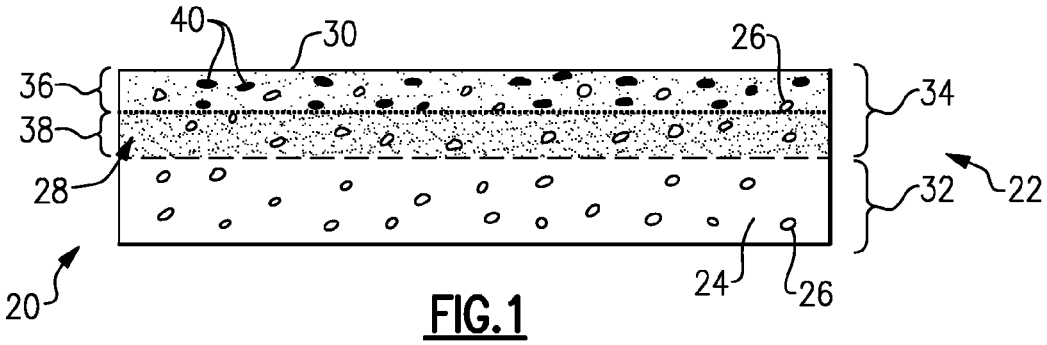
FIG. 1 illustrates an example wear resistant device.

FIG. 1 illustrates an example wear resistant device 20 that may be provided individually or in combination with other components for enhanced wear resistance against a wide variety of different wear mechanisms. In this case, the wear resistant device 20 includes a wear resistant layer 22 (e.g., coating) that includes a matrix 24, particulates 26 that are dispersed throughout the matrix 24, and a boron material 28 (as represented by the shaded areas) that is distributed within a portion of the matrix 24.

The boron material 28 provides the benefit of hardening the matrix 24 to increase wear resistance and thereby facilitates holding the particulates 26 within the matrix 24. As an example, the wear resistant device 20 includes an outer surface 30 that may be subjected to wear conditions. In the absence of the boron material 28, the matrix material 24 may wear away and gradually expose the particulates 26 such that the particulates 26 may become loose or free from the matrix 24. Once free, the particulates may act as wear particles and accelerate wear. However, the presence of the boron material 28 hardens the outer portion of the matrix 24 to reduce wear and facilitate holding the particulates 26 within the matrix 24.

The wear resistant layer 22 may include an inner portion 32 and an outer portion 34. In this case, the terms "inner" and "outer" are made with reference to the wear surface 30 but alternatively may be made with reference to other components or reference points with regard to the wear resistant layer 22. In this example, the outer portion 34 includes the boron material 28, and the inner portion 32 is free of any of the boron material 28. In this regard, the inner portion 32 is not as hard as the outer portion 34 and maintains a greater degree of ductility. In a case where a crack would form in the outer portion 34, the ductility of the inner portion 32 that is free of any of the boron material 28 may facilitate arresting propagation of the crack.

In some examples, the outer portion 34 may include a first sublayer 36 at the outermost side near the wear surface 30 and a second sublayer 38 that is adjacent to the first sublayer 36 and the inner portion 32. In this case, each of the first and second sublayers 36 and 38 include the boron material 28, however, the boron material 28 may be in a different form in each of the sublayers 36 and 38. For instance, the boron material 28 may be present as a boride in the first sublayer 36 and as elemental boron in the first and second sublayers 36 and 38. The first sublayer 36 may therefore be regarded as a boride-rich layer relative to the second sublayer 38. A boride may be considered to be a chemical compound between boron and a less electronegative element, and elemental boron is not chemically bonded to any other types of elements.

The first sublayer 36 may include boride particulates or phases 40 dispersed throughout the first sublayer 36. The concentration of the boride particulates or phases 40 may decrease or change as a function of distance through the thickness of the wear resistant layer 22 from the wear surface 30 toward the second sublayer 38.

The type of boride may also change as a function of distance from the wear surface 30. For instance, a first type of boride phase may be present near the wear surface 30 while another type of boride may be primarily present deeper into the first sublayer 36.

As an example, the boride or borides may include compounds of boron with a metal from the matrix 24. In this regard, the types of boride present may depend on the type of metal or alloy selected for the matrix 24. In some examples, the metallic material of the matrix 24 may be cobalt, nickel, cobalt-phosphorus, nickel-phosphorous, nickel-tungsten, or combinations thereof. In such examples, the boride may include nickel boride or cobalt boride.

The boride may also be a combination of boron with a metal from the particulates 26. As an example, the particulates 26 may be a metal carbide, metal oxide, or other material that is generally harder than the material of the matrix 24. For instance, the particulates may be aluminum oxide, silicon carbide, chromium carbide, tungsten carbide, or other non-boride material. In this regard, the boride may include boron with aluminum, silicon, chromium, or tungsten. Alternatively, the particulates may be boron nitride or a diamond material, which may be unreactive with respect to the boron.

The particles 26 may have an average size up to about 20 micrometers. In further examples, the size may be 2-10 micrometers or even 8-10 micrometers. Generally, the size is larger than the size of the boride particulates or phases 40, which is usually less than 2 micrometers.

The outer portion 34 may be formed with a desired thickness relative to the thickness of the wear resistant layer 22, depending upon the required wear resistance properties. In some examples, the wear resistant layer 22 includes a through-thickness ratio of the thickness of the outer portion 34 to the total thickness of wear resistant layer 22 that is 0.5 or less. That is, the thickness of the outer portion 34 may be up to about 50% of the thickness of the wear resistant layer 22. In some examples, the thickness of the outer portion 34 may be as much as about 2.5 mils (0.635 millimeters). In a further example, the thickness of the outer portion 34 may be 1.2 mils (0.305 millimeters) or less.

The combination of the given example materials of the matrix 24, particulates 26, and outer portion 34 that includes the boron material 28 provides wear resistance characteristics that compare favorably to chromium plating or other wear resistant layers. For instance, chromium plating exhibits outstanding wear resistance against mating metal components but not against aluminum oxide particles. A composite of the matrix 24 and particulate 26 without the boron material 28 exhibits good wear resistance when in contact with certain alloys but less resistance to other alloys under elevated temperatures. In comparison, the wear resistant layer 22 with the matrix 24, particulates 26, and boron material 28 has good resistance to aluminum oxide wear particles and a variety of different alloys at elevated temperatures. That is, the wear resistant layer 22 provides wide range of wear resistance with regard to many different types of wear mechanisms.

Figure 2:
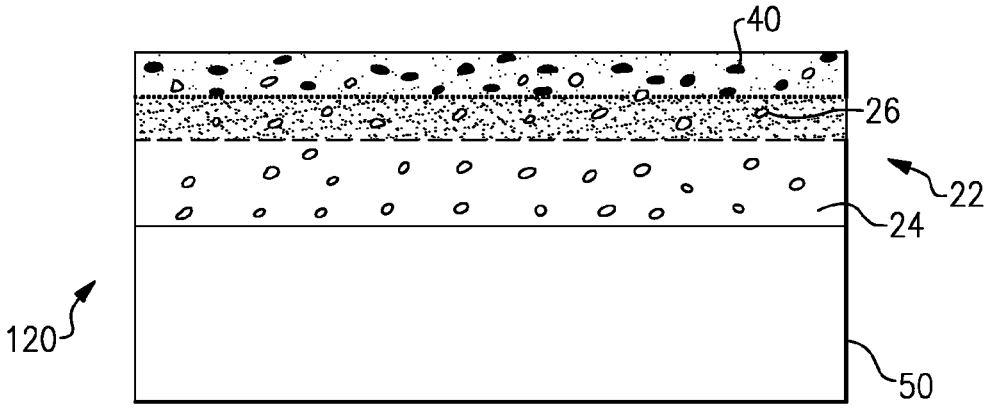
FIG. 2 illustrates another example wear resistant device.

FIG. 2 illustrates another wear resistant device 120. In this case, the wear resistant device 120 includes the wear resistant layer 22 disposed on a substrate 50. In this example, the substrate 50 is made of a metallic material, such as an iron-based alloy, a nickel-based alloy, a cobalt-based alloy, a nickel-chromium alloy, a cobalt-chromium alloy, titanium alloys, or a combination thereof. That is, the metallic material of the substrate 50 is different than the metallic material of the matrix 24 of the wear resistant layer 22.

In general, the substrate 50 may be the body of a component on which the wear resistant layer 22 is disposed. In this regard, the wear resistant layer 22 may be directly deposited onto the substrate 50 or separately formed as an individual component and then later attached or bonded to the substrate 50. As an example, the component may be an actuator (bore), shaft, air cycle machine component, propeller blade, turbine, or any type of component having a wear surface that would benefit from the disclosed examples.

The wear resistant layer 22 may be processed to incorporate the boron material 28 into the matrix 24. As an example, the matrix may be formed with the particulates 26 in a known manner, such as in an electroplating process. The boron material 28 may be subsequently incorporated into the matrix 24 in a "boronizing" process. In the boronizing process, boron diffuses into the matrix 24. The process may be conducted at an elevated temperature, such as about 537-1094° C. for a duration that is suitable to produce a desired microstructure and thickness of the outer portion 34. In further examples, the boronizing temperature may be about 648-983° C. or even 760-927° C. The boronizing temperature may be selected to provide an additional benefit of interdiffusing the particulates 26 and the matrix 24 to enhance bonding. The boronizing temperature may also be selected to provide an additional benefit of interdiffusing the matrix 24 and the substrate 50 to enhance bonding. In this regard, the selected boronizing temperature may depend on the type of material selected for the substrate 50. For substrates that are nickel-based materials or cobalt-based materials, the temperature range of 760-927° C. may be suitable to effect interdiffusion with the given example matrix materials. In this regard, diffusion bonding may occur in unison with boronizing.

The source of the boron may be a solid compound, powder, paste, liquid, or gaseous atmosphere. The boron diffuses into the matrix 24 such that there is a higher concentration of boron near the surface 30 than there is at a location which is farther from the surface 30.

When the boron concentration exceeds a solubility limit in the matrix 24, excess boron forms the boride particles or phases 40 in the first sublayer 36. In some examples, the amount of boron in the second sublayer 38 does not exceed the solubility limit and therefore, remains interstitially or in solution within the matrix 24 such that borides do not form. Thus, the time, temperature, and type of boron source may be controlled in the boronizing process to produce a desirable thickness of the first sublayer 36, second sublayer 38, and type of boride that result.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A wear resistant device comprising:

a substrate comprised of a first metallic material; and a wear resistant layer disposed on the substrate, the wear resistant layer being comprised of a matrix of a second, different metallic material extending continuously between a first surface at the substrate and a second, opposite surface, particulates dispersed throughout the matrix, and a boron material distributed exclusively within a surface zone of the matrix extending from the second surface to a location intermediate of the second surface and the first surface, the particulates being selected front the group consisting of oxide particulates, carbide particulates and combinations thereof, the carbide particulates being selected from a group consisting of silicon carbide, chromium carbide, diamond, and combinations thereof, and the second metallic material being selected from a group consisting of cobalt, nickel, cobalt-phosphorus, nickel-phosphorous, nickel-tungsten, and combinations thereof.

2. The wear resistant device as recited in claim 1, wherein the wear resistant layer includes an inner sublayer portion relative to the substrate which is free of any of the boron material.

3. The wear resistant device as recited in claim 1, wherein the wear resistant layer includes an inner sublayer adjacent to the substrate and first and second outer sublayers relative to the substrate, the first outer sublayer including boride as the boron material and the second outer sublayer including elemental boron as the boron material, wherein the inner sublayer is free of any of the boron material.

4. The wear resistant device as recited in claim 1, wherein the first metallic material is selected from a group consisting of iron-based alloys, nickel-based alloys, cobalt-based alloys, nickel-chromium alloys, cobalt-chromium alloys, titanium alloys, and combinations thereof.

5. The wear resistant device as recited in claim 1, wherein the particulates are selected from a material that is harder than the second metallic material and have an average size of no greater than twenty micrometers.

6. The wear resistant device as recited in claim 1, wherein at least some of the boron material is boride.

7. The wear resistant device as recited in claim 1, wherein at least some of the boron material distributed within the surface zone of the matrix is elemental boron.

8. The wear resistant device as recited in claim 1, wherein the boron material comprises a boride with a metal of the second metallic material.

9. The wear resistant device as recited in claim 1, wherein a through-thickness ratio of the surface zone of the matrix with the boron material to the total thickness of the wear resistant layer is 0.5 or less.

10. The wear resistant device as recited in claim 1, wherein the boron material distributed within the surface zone of the matrix includes boride and elemental boron.

11. The wear resistant device as recited in claim 1, wherein the first metallic material is selected from the group consisting of nickel-based alloy, nickel-chromium alloy, cobalt-chromium alloy, titanium alloy and combinations thereof.

12. The wear resistant device as recited in claim 1, wherein the second metallic material is nickel.

13. The wear resistant device as recited in claim 1, wherein the second metallic material is cobalt-phosphorous.

14. The wear resistant device as recited in claim 1, wherein the second metallic material is nickel-phosphorous.

15. The wear resistant device as recited in claim 1, wherein the second metallic material is nickel-tungsten.

16. The wear resistant device as recited in claim 1, wherein the particulates are aluminum oxide.

17. The wear resistant device as recited in claim 1, wherein the particulates are silicon carbide.

18. The wear resistant device as recited in claim 1, wherein the particulates are chromium carbide.

19. The wear resistant device as recited in claim 1, wherein the particulates are diamond.

* * * * *